United States Patent [19]

Czinger

[11] 4,064,803

[45] Dec. 27, 1977

[54] PRINTING SADDLE WITH ROCKER ARM LOCKUP

[75] Inventor: David B. Czinger, Huntington Beach, Calif.

[73] Assignee: Beach Manufacturing Corporation, Huntington Beach, Calif.

[21] Appl. No.: 721,105

[22] Filed: Sept. 7, 1976

[51] Int. Cl.[2] ..... B41F 27/14

[52] U.S. Cl. ..... 101/415.1

[58] Field of Search ..... 101/415.1, 378

[56] References Cited

U.S. PATENT DOCUMENTS

| | | | |
|---|---|---|---|
| 2,075,559 | 3/1937 | Tollison | 101/378 |
| 3,973,496 | 8/1976 | Cerny et al. | 101/415.1 |

*Primary Examiner*—J. Reed Fisher

*Attorney, Agent, or Firm*—Fulwider, Patton, Rieber, Lee & Utecht

[57] ABSTRACT

There is disclosed a printing saddle including a semicylindrical shell formed interiorly with a rocker arm recess projecting axially from the mid-portion thereof to one end thereof and also a circumferentially extending link recess projecting from the inner extremity of the rocker arm recess to one side of the shell. A biasing bar is mounted along such one side of the shell and is biased thereaway from by means of biasing springs. An elongated rocker arm is received in the rocker arm recess and pivotally mounted medially from the shell and has its inner extremity connected with the biasing bar by means of an arcuate link received in such link recess. A lock is mounted from the shell adjacent the free end of the rocker arm and is engaged by such free end upon rotation of the rocker arm to retract the biasing bar to its retracted position to thus lock such biasing bar in its retracted position. A lever handle may be provided for engagement with the free end of the rocker arm to retract such rocker arm.

6 Claims, 5 Drawing Figures

FIG. 1
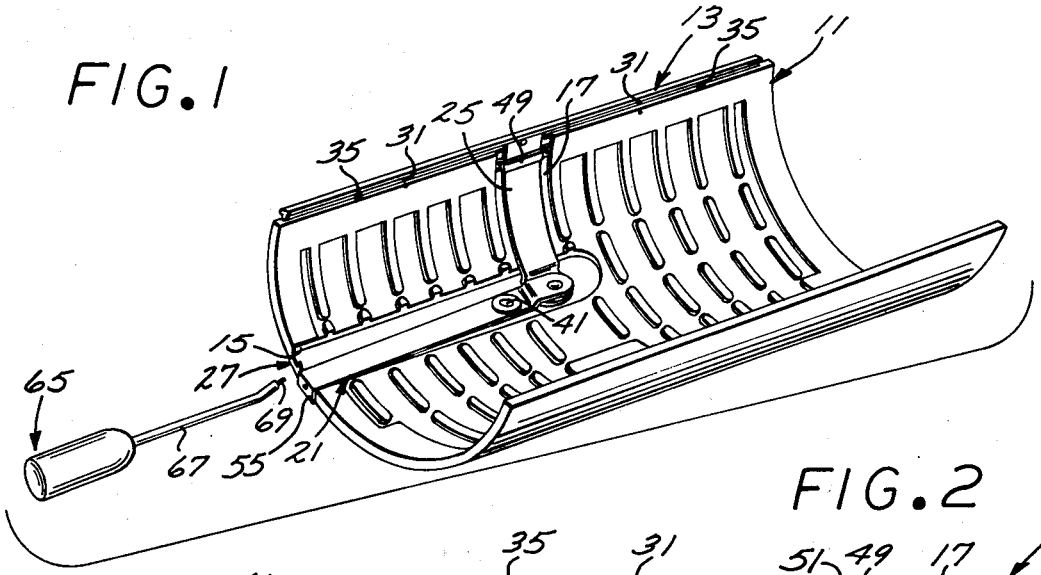
FIG. 2
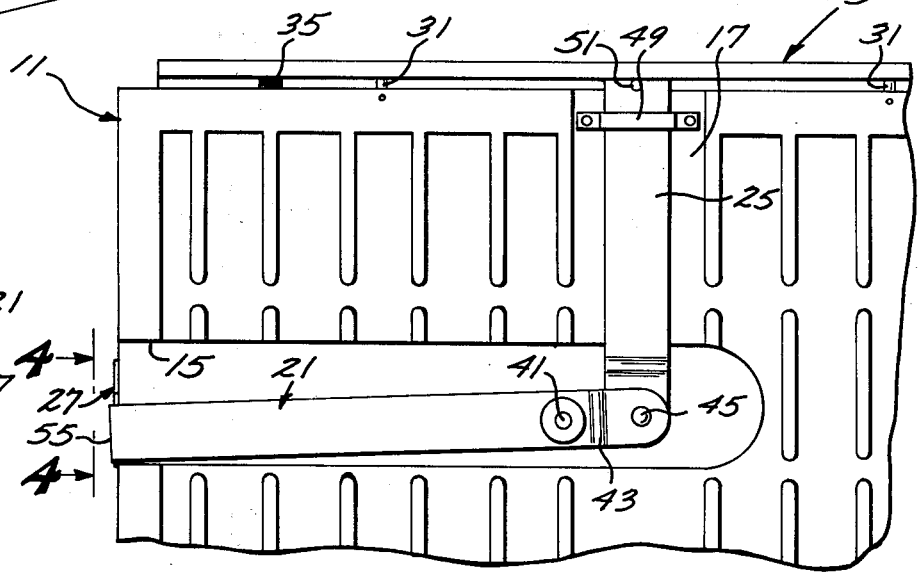
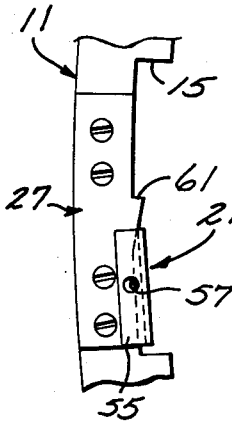
FIG. 4
FIG. 3
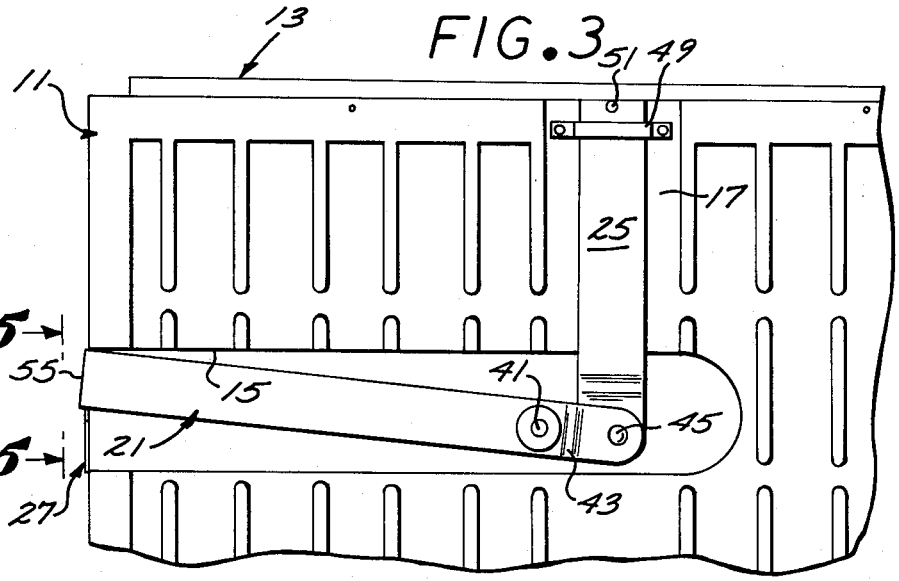
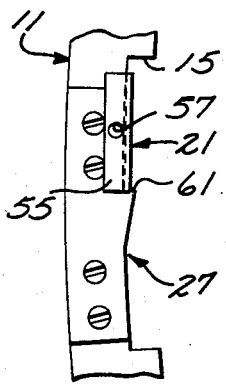
FIG. 5

PRINTING SADDLE WITH ROCKER ARM LOCKUP

BACKGROUND OF THE INVENTION

1. Field of the Invention

The present invention relates to semicylindrical saddles mounted on rotary printing drums to facilitate mounting thereon of flexible printing plates.

2. Description of the Prior Art

With the present day popularity of rotary printing presses employing semicylindrical shells mounted thereon for receipt of printing plates, numerous arrangements have been proposed for conveniently securing such printing plates to the saddles. One such arrangement employs a locking ball arrangement which is operative upon depression of the biasing bar to automatically lock it in its recessed position and may conveniently be released by merely depressing a plunger in the ball lock mechanism. An arrangement of this type is shown in my U.S. Pat. No. 3,943,852. Such devices suffer the shortcoming that relatively precise machining is required to form the ball lock mechanisms and painstaking efforts are required for installation and assembly thereof.

Other lockup arrangements have been proposed for printing saddles, including the provision of rotary grippers disposed along one side thereof and biased to a gripping position. An arrangement of this type is shown in U.S. Pat. No. 3,727,551. Such devices also suffer the shortcoming that construction and assembly thereof is relatively sophisticated and expensive.

SUMMARY OF THE INVENTION

The rocker arm actuated printing saddle of the present invention is characterized by a series of recesses formed in the interior of the semicylindrical saddle for receipt of a longitudinally extending pivotally mounted rocker arm conected with a biasing bar disposed along one side of the saddle by means of a connecting link. The rocker arm projects to one axial extremity of the saddle and has a lock mounted adjacent thereto and operative upon shifting of the rocker arm to draw the biasing bar to its retracted position to engage such free end and lock the biasing bar in its retracted position.

BRIEF DESCRIPTION OF THE DRAWINGS

FIG. 1 is a perspective view of a rocker arm actuated printing saddle embodying the present invention;

FIG. 2 is a top broken plan view in enlarged scale, of the printing saddle shown in FIG. 1;

FIG. 3 is a top plan view similar to FIG. 2 and showing the saddle in its retracted and locked position;

FIG. 4 is an end view taken along the line 4—4 of FIG. 2; and

FIG. 5 is an end view, in enlarged scale, taken along the line 5—5 of FIG. 3.

DESCRIPTION OF THE PREFERRED EMBODIMENT

Referring to FIGS. 1 and 2, the rocker arm actuated printing saddle of the present invention includes, generally, a semicylindrical saddle shell 11 having a biasing bar 13 mounted along one edge thereof. The saddle shell 11 is formed with a rocker arm cavity 15 projecting axially inwardly from one end thereof and joining at its axially inner extremity with a centrally located circumferentially extending link recess 17 which extends outwardly to the biasing bar 13. A rocker arm, generally designated 21, is pivotally mounted medially in the recess 15 and has a connecting link 25 connected between the inner extremity thereof and the biasing bar 13. Referring to FIGS. 4 and 5, a lock 27 is mounted on the end of the shell 11 adjacent the free extremity of the rocker arm 21 and is engageable therewith when such rocker arm is shifted to its position retracting the biasing bar 13 to the position shown in FIG. 3 to engage such free end of the rocker arm 21 and lock the biasing bar in its retracted position. The rocker arm 21 may subsequently be released to release the biasing bar 13 to be extended to its extended position.

Referring to FIG. 2, the biasing bar 13 is in the form of a longitudinally extending strip having telescopical drive pins 31 aligning it with the edge of the shell 11 and is biased to its extended position by means of coil springs 35.

The rocker arm 21 is in the form of a flat stock which is mounted fully recessed within the recess 15 and is carried adjacent its inner extremity from the shell 11 by means of a pivot pin 41 and is then offset slightly at 43 for receipt under the inner extremity thereof of the inner extremity of the connecting link 25, such rocker arm and connecting link being pivotally connected together by means of a pivot pin 45. The arm itself is resilient and is mounted from the pivot pin 41 to be held against the shell 11 to retain the free extremity of such arm biased against the shell itself. The connecting link 25 is in the form of an arc having a radius of curvature to compliment the curvature of the shell 11 itself and the outer extemity thereof is received telescopically beneath a retaining bracket 49 and is pivotally connected at its outer extremity to the biasing bar 13 by means of a pivot pin 51.

Referring to FIGS. 4 and 5, the free extremity of the rocker arm 21 forms a latch keeper and is bent radially outwardly with respect to the curvature of the shell 11 to form an end flange 55 formed with a lever arm receiving aperture 57.

Still referring to FIGS. 4 and 5, the locking plate 27 is mounted from the end of the shell 11 over the end of the rocker arm recess 15 and is formed with a cutback notch forming a hook 61 arranged to engage the keeper formed by free end of such rocker arm when such rocker arm is rotated upwardly to the latched position shown in FIG. 5.

An actuating handle, generally designated 65, is provided with a stem 67 terminating in a reduced-in-diameter prong 69 receivable in the bore 57 so such handle 65 may be utilized to shift the rocker arm 21 to its retracted position.

In operation, the saddle 11 is mounted on a rotary printing drum and when it is desirable to mount a printing plate thereon, the handle 65 may have its prong 69 inserted in the bore 57 (FIG. 4) and the leverage of such handle utilized to rotate the rocker arm 21 clockwise as viewed in FIG. 2 to retract the biasing bar 13 against the bias of the springs 35. When such biasing bar 13 reaches its fully retracted position, the bottom edge of the free extremity of the rocker arm 21, as viewed in FIG. 5, will register with the lock notch 61 and the inherent resiliency of the rocker arm 21 will shift the free extremity thereof downwardly behind the notch 61 to lock the bar 13 in its retracted position.

The printing plate may then conveniently be secured to attachment points on opposite sides of the saddle 11 and on the biasing bar 13 and the free extremity of the rocker arm 21 then lifted out of registration with the notch 61 to free such rocker arm to be rotated about the pivot pin 41 under the influence of the biasing springs 35 to thus rotate such rocker arm back to its position shown in FIG. 4 to thus apply tension to the printing plate secured about the outer periphery of the saddle 11. Such bias on the printing plate will positively hold such printing plate in its mounted position on the saddle 11 upon subsequent rapid rotation of the printing drums during the printing operation, thus providing for a system of high integrity.

It is of particular importance that the biasing bar 13 is locked in its retracted position by means of a locking arrangement of relatively straightforward construction to maintain such biasing bar in its retracted position during the entire mounting procedure thus negating the requirement for stepwise advancement of the rotary drums during the mounting procedure, thereby not only saving time and conveniencing the work personnel, but eliminating the dangers pendant normal stepwise mounting of printing plates and consequent proximity of a workman's hands and fingers to the printing drums themselves.

Various modifications and changes may be made with regard to the foregoing detailed description without departing from the spirit of the invention.

I claim:

1. Rocker arm actuated printing saddle apparatus comprising:

an elongated semicylindrical shell formed on its interior with a medial rocker arm recess leading to one end of said shell and a central link recess leading from the inner extremity of said rocker arm recess to one side of said shell;

a biasing bar projecting along said one side;

biasing means biasing said bar away from said one side of said shell;

an elongated resilient rocker arm disposed in said rocker arm and terminating at its outer extremity in a latch keeper shiftable between latched and unlatched positions upon rotation of said rocker arm in opposite directions;

pivot means pivotally mounting said rocker arm medially from said shell to retain said arm against said shell to urge said latch keeper resiliently against said shell;

a link connecting the inner extremity of said rocker arm with said biasing bar to cause said biasing means to bias said arm in one direction to said unlatched position; and lock means mounted on said shell adjacent the free extremity of said rocker arm including a hook positioned to cause said rocker arm to resiliently urge said keeper into engagement therewith when said arm is in its latched position whereby said biasing bar will be normally biased to pivot said rocking arm to its unlatched position but upon rotation of said rocker arm to its latched position said latch keeper will be engaged with said hook to retain said biasing bar retracted.

2. The rocker arm actuated printing saddle apparatus of claim 1, wherein:

said outer extremity of said arm is formed with a radially outturned flange formed with a bore; and said apparatus includes an elongated lever handle having an extremity formed with a prong receivable in said bore.

3. The rocker arm actuated printing saddle apparatus of claim 1, wherein:

said connecting link is pivotally connected with said arm and said bias bar.

4. The rocker arm actuated printing saddle apparatus of claim 1, wherein:

said rocker arm is formed on its inner extremity with an offset and one extremity of said link is received thereunder.

5. The rocker arm actuated printing saddle apparatus of claim 2, wherein:

said connecting link is pivotally connected with said arm and said bias bar.

6. The rocker arm actuated printing saddle apparatus of claim 4, wherein:

said rocker arm is formed on its inner extremity with an offset and one extremity of said link is received thereunder.

* * * * *